US009728169B2

(12) United States Patent
Zwieg

(10) Patent No.: US 9,728,169 B2
(45) Date of Patent: Aug. 8, 2017

(54) ACOUSTIC DAMPENING FOR MUSICAL STRINGS; USE, METHOD, AND STRING

(71) Applicant: Larsen Strings A/S, Sonderborg (DK)

(72) Inventor: Thomas Zwieg, Aabbenraa (DK)

(73) Assignee: Larsen Strings A/S, Sonderborg (DK)

( * ) Notice: Subject to any disclaimer, the term of this patent is extended or adjusted under 35 U.S.C. 154(b) by 11 days.

(21) Appl. No.: 14/426,076

(22) PCT Filed: Sep. 3, 2013

(86) PCT No.: PCT/DK2013/050277
§ 371 (c)(1),
(2) Date: Mar. 4, 2015

(87) PCT Pub. No.: WO2014/037012
PCT Pub. Date: Mar. 13, 2014

(65) Prior Publication Data

US 2015/0269917 A1 Sep. 24, 2015

Related U.S. Application Data

(60) Provisional application No. 61/699,952, filed on Sep. 12, 2012, provisional application No. 61/696,370, filed on Sep. 4, 2012.

(30) Foreign Application Priority Data

Sep. 4, 2012 (EP) ..... 12182951

(51) Int. Cl.
*G10D 3/10* (2006.01)

(52) U.S. Cl.
CPC ..... *G10D 3/10* (2013.01)

(58) Field of Classification Search
CPC . G10D 3/10; G10D 1/00; G10D 1/005; D07B 2801/22; D07B 2205/2046; D07B 2205/3007; D07B 2801/16; D07B 2801/02
(Continued)

(56) References Cited

U.S. PATENT DOCUMENTS 2,049,769 A 8/1936 Gray
2,049,770 A 8/1936 Gray
(Continued)

FOREIGN PATENT DOCUMENTS

AT 506135 B1 11/2009
CN 2351798 Y 12/1999
(Continued)

OTHER PUBLICATIONS

EP 12182951 European Patent Office, European Search Report, Feb. 25, 2013.
(Continued)

*Primary Examiner* — Kimberly Lockett
(74) *Attorney, Agent, or Firm* — Ice Miller LLP

(57) ABSTRACT

A viscoelastic polymer matrix is used for configuration and adjustment of acoustical properties of a musical string for bowed and plucked instruments; the polymer matrix is not covering the surface of the string but is provided between the core and the at least one sheath or between wound sheaths around the core: The polymer matrix comprises a polymeric binding agent and insoluble, sub-micrometer size, nano-scale solid state particles embedded in the binding agent.

25 Claims, 3 Drawing Sheets

(58) Field of Classification Search
USPC ..... 84/297 R, 297 S
See application file for complete search history.

(56) References Cited

U.S. PATENT DOCUMENTS

| | | | | |
|---|---|---|---|---|
| 2,641,949 | A | 6/1953 | Jensen | |
| 2,710,557 | A | 6/1955 | Sundt | |
| 2,762,251 | A * | 9/1956 | Infeld | G10D 3/10 84/199 |
| 3,610,084 | A | 10/1971 | Behringer | |
| 7,893,331 | B2 * | 2/2011 | Klanner | G10D 3/10 84/297 S |
| 2003/0196538 | A1 * | 10/2003 | Katchanov | G10D 3/10 84/297 S |
| 2008/0124546 | A1 | 5/2008 | Yaniv et al. | |
| 2009/0158912 | A1 | 6/2009 | Nesbitt | |
| 2010/0071529 | A1 * | 3/2010 | Infeld | G10D 3/10 84/297 S |
| 2010/0294109 | A1 | 11/2010 | Rieger | |

FOREIGN PATENT DOCUMENTS

| | | | |
|---|---|---|---|
| CN | 101534909 | A | 9/2009 |
| DE | 1040350 | | 4/1950 |
| DE | 851450 | | 10/1952 |
| DE | 963830 | | 5/1957 |
| DE | 1800355 | | 4/1970 |
| EP | 0329924 | | 11/1988 |
| EP | 0775994 | A3 | 11/1999 |
| EP | 1531454 | A2 | 5/2005 |
| EP | 2099022 | | 9/2009 |
| EP | 2131352 | | 12/2009 |

OTHER PUBLICATIONS

PCT/DK2013/050277 International Searching Authority, Written Opinion, Oct. 9, 2013.
PCT/DK2013/050277 International Searching Authority, International Search Report, Oct. 9, 2013.
PCT/DK2013/050277 International Searching Authority, International Preliminary Report on Patentability, Nov. 18, 2014.
Chinese Search Report, dated Mar. 20, 2017.

* cited by examiner

Figure 1:
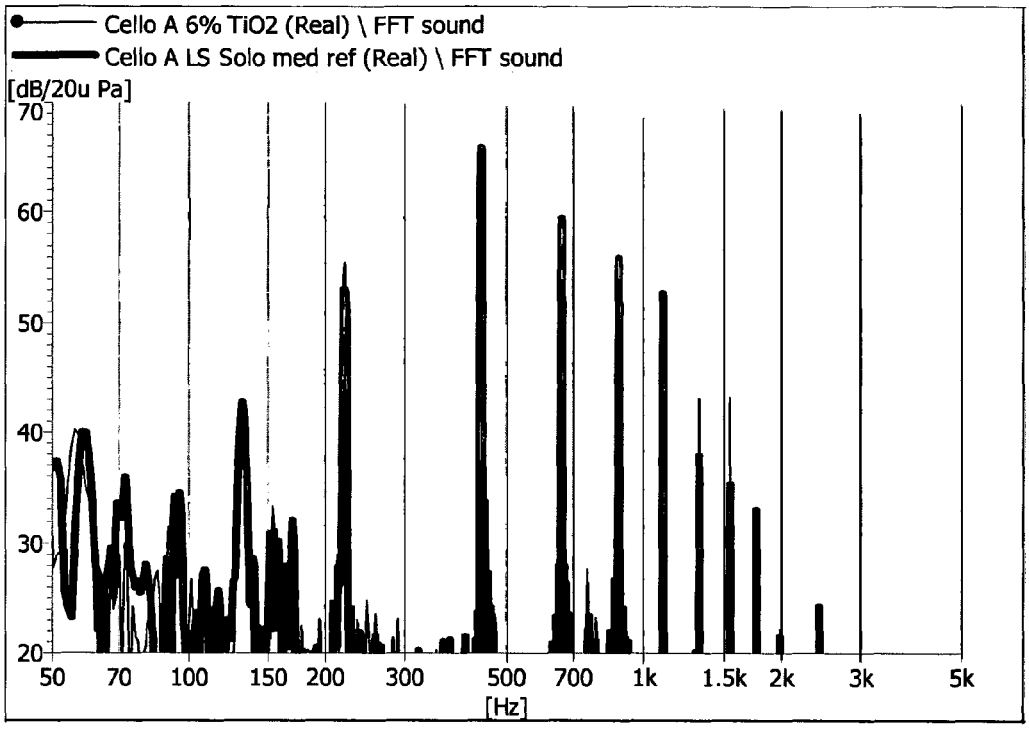

Figure 1: Sound spectrum of a Cello A string without (green) and with particle addition (red, 6% $TiO_2$), corresponding to the preferred embodiment 3

Figure 2:
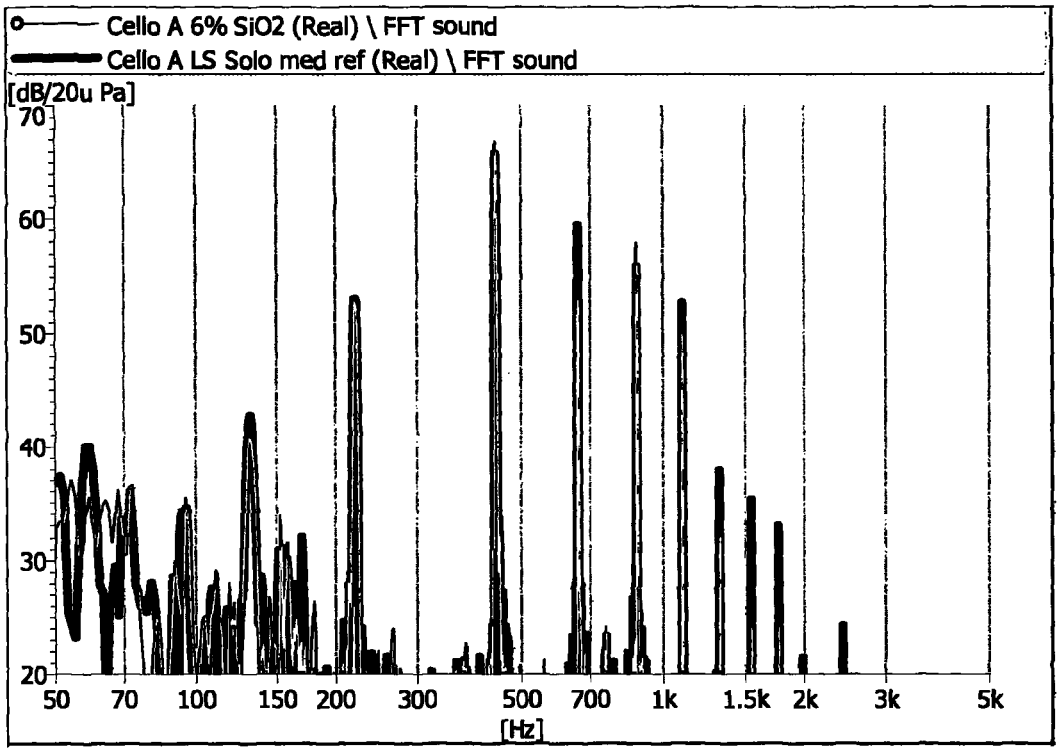

Figure 2: Sound spectrum of a Cello A string without (green) and with particle addition (red, 6% $SiO_2$), corresponding to the preferred embodiment 4

ACOUSTIC DAMPENING FOR MUSICAL STRINGS; USE, METHOD, AND STRING

CROSS-REFERENCE TO RELATED APPLICATIONS

The present application is a national stage of and claims the priority benefit of PCT Application Serial No. PCT/DK2013/050277, filed Sep. 3, 2013, the text and drawings of which are hereby incorporated by reference in their entireties.

FIELD OF THE INVENTION

The invention relates to strings of music instruments and the method of production as well as the use of a sound dampening polymer matrix in a musical string, for example for bowed and plucked instruments; the polymer matrix being provided between the core of the musical string and at least one sheath wound around that core or between wound sheaths around the core or both; the polymer matrix comprises a polymeric binding agent and insoluble, sub-micrometer size, nano-scale solid state particles embedded in the binding agent.

DESCRIPTION OF PRIOR ART

The main component of a musical string is a core, which carries the strain of its tension. The core can consist of solid metal wire, multi-stranded helical metal wire of various winding, polymer mono- or multi-filaments, as well as natural fibers and natural materials such as animal gut. In addition, most musical strings have further winding layers in the form of round or flat wire wound around the core for the string to reach a specified density of mass. Typical winding materials include suitable metals and polymer materials as well as synthetic and natural fibers.

Examples of string constructions, possible core structures and suitable winding materials are listed and described, among others, in the following patent documents: U.S. Pat. No. 2,641,949, U.S. Pat. No. 2,049,770, U.S. Pat. No. 2,049,769, DE 1040350, DE 851450, DE 963830, U.S. Pat. No. 2,710,557, U.S. Pat. No. 3,610,084, DE 1800355, EP 0329924, EP 2131352 and EP 2099022.

As a further component of string construction, a dampening and/or binding agent can be added to the string. Examples of such agents are natural rubbers or synthetic waxes or resins, lacquers and adhesives. Examples and applications are provided, among others, in the following patent records: U.S. Pat. No. 2,710,557, EP 0329924, EP 2131352 and EP 2099022.

Dampening agents are used especially in strings for bowed instruments, and in particular for those strings that have a metal core, whether solid metal wire, metal wire bundles or multi-stranded helical metal wire. The dampening and/or binding agent can be applied within the core (wire bundles or multi-stranded metal helical wire), onto the core, onto and in between subsequent winding layers, and on the string surface.

US2003/0196538 discusses the infusion of ferromagnetic metal particles in a synthetic monofilament string core. The aim of this infusion is to increase the mass density of the core, such that further winding with metal wire may be avoided, as this causes unwanted sliding noises when the finger is moved on the surface of the string during play. In addition, this application would allow for electrical amplification via magnetic pick-up of the acoustic signal from otherwise non-magnetic strings.

AT506135/U.S. Pat. No. 7,893,331 describe the infusion of magnetic particles in the dampening agent of musical strings. The aim of this application is a magnetically induced, irreversible change in vibration and/or sound properties of the string while used by the musician and/or while under the influence of external magnetic forces. AT506135 also describes the infusion of carbon nano-fibers or carbon nano-spheres in the binding agent. This concept aims to irreversibly change the vibration and/or sound properties of the string while used by the musician and/or while under influence of external radiation or heat energy. Furthermore, AT506135 describes the envisioned infusion of micro-containers, which are filled with an additional fluid, separated from the binding agent matrix by the container capsule. The aim of this invention is irreversible change of the chemical composition of the binding agent matrix, and to the vibration and sound properties of the string while used by the musician and/or while under the influence of mechanical forces, which are thought to rupture the capsules.

US2009/0158912 discloses a musical string that has a low friction top coat and a base layer with heat activated pigments in order to provide special colors to the string, for example colors varying between sections along the string, which can be used as indicators. Also, the coating may contain antimicrobial agents or corrosion resistant agents on the outer surface or the interstices of the wound musical string. The coating provides corrosion resistance without affecting the tonal quality of the string.

The great challenge in constructing a string is the configuration and adjustment of its acoustical properties, and thus the resulting sound. With basic selection of core and winding materials, the desired properties can be only approximated. The finer adjustment of the sound characteristics is highly difficult. Also, the choice of materials for the construction of strings is naturally limited. For example, the preferred density of winding materials are largely unavailable, and the selection of dampening and binding agents is limited, as their necessary properties are highly specific and because dermatological tolerance and health and safety requirements must be met. As a consequence, the fine adjustment of sound characteristics of musical strings is difficult and always tainted by unwanted compromise.

DESCRIPTION

It is the objective to improve the musical quality of strings. It is a further objective to provide a new technology for influencing and adjusting the sound characteristics of musical strings through markedly improved dampening and binding agents. This objective is achieved with a use, method and string as explained in the following.

According to the invention, a viscoelastic polymer matrix containing nano-particles, for example nano-particle agglomerates, distributed in the matrix is used for configuration and adjustment of acoustical properties of a musical string, for example for bowed and plucked instrument. The string comprises a core and at least one sheath wound around that core. A polymer matrix is applied to the core and/or the sheath. Advantageously, the polymer matrix is provided between the core and at least one sheath wound around that core. Additionally, or alternatively, is it provided between wound sheaths around the core. The polymer matrix comprises a polymeric binding agent and insoluble, sub-micrometer size, nano-scale solid state particles embedded in the binding agent.

The matrix is peculiar in being viscoelastic. The viscoelasticity implies that the polymer matrix advantageously is not provided as a covering of the surface of the string, because the viscoelasticity would lead to deformation on the surface of the string. Also, the viscoelastic properties make the polymer matrix sticky, thus the matrix has a high friction, which is unsuitable for the surface of the string. This is in sharp contrast to the aforementioned low-friction top coat of the string as disclosed in US2009/0158912. However, such low friction top coat may be combined with a viscoelastic matrix under the top coat.

Due to the elastic-viscosity, however, the deformation of the polymer matrix during playing music of the string induces forces of that imply hysteresis in the internal vibrational movement of the string, leading to a dampening effect in the vibrations. This dampening effect is dependent on the frequency of the vibration, thus, altering the sound spectrum such that certain frequencies are relatively suppressed, for example the high pitch frequencies. Such a reduction of the high pitch frequencies reduces or even removes the metallic sound of a string.

Examples of materials for such viscoelastic binding agent are natural resins, preferable natural resins based on colophony and colophony derivates, synthetic resins, preferable polyamide and polyimide resins, phenolic resins, polyester resins and epoxy resins.

The invention achieves an improvement through the controlled addition/infusion of insoluble, sub micrometer sized, nano-scale inorganic and/or inorganic-organic solid particles into the polymer matrix, which contain a binding agent. The binding agent has a dampening effect in itself due to its viscoelasticity, however, the dampening effect is further adjusted and supported by the addition of the particles. The solid state particles embedded in the binding agent, thus, being part of the polymer matrix, assist in the sound dampening properties, especially, when they agglomerate into a network.

These solid nano-scale particles are of sizes ranging from 10 nm to 500 nm, for example between 10 and 250 nm in average size. For spherical particles or approximately spherical particles, the term "size" covers the diameter for the particles, whereas for irregular particles, the term "size" covers the one dimensional length/width averaged over the particle in all three dimensions. For a group of particles having various sizes, the term "size" is averaged over the group of particles.

Particles of the sub-micron size with such above described dimensions are henceforth referred to as nano-particles. Nano-particles commonly display strong inclination to agglomerate. Through their infusion into the matrix with the binding agent, such as a lacquer, the nano-particles, if provided at a suitable concentration, agglomerate and form a mesh network of independently mobile nano-particle agglomerates in the polymer matrix.

In order to induce the agglomeration, the concentration of the sub-micrometer size, nano-scale solid state particles is adjusted to above a pre-determined limit, wherein the pre-determined limit is equal to or above the lower concentration limit for formation of a mesh network of independently mobile agglomerates. As an example, the pre-determined lower concentration limit is 10, 20 or 30 grams per kg of the polymer matrix with the binding agent and the particles. Typically, the upper limit of particle concentration is 100 g/kg or 60 g/kg. An especially useful interval is 20-60 or 30-60 grams of particles per kg matrix. However, it depends weakly on the type of particles. Typically, the polymer matrix comprises only binding agent and particles. However, the polymer matrix may also optionally contain useful additives, fungicides, bactericides, preservatives, or other protecting or otherwise assisting agents; the concentration of which relatively to the concentration of binding agent is lower, however, for example a factor of at least 5 or at least 10 lower. The viscosity of the polymer matric largely corresponds to the viscosity of the binding agent, and is, for example, in the range of 60,000-500,000 or 60,000-400,000 mPa*s at 25° C.

Useful additives in the polymer matrix are catalysts, inhibitors, photo-initiators, UV absorber, adhesion promotors, anti-statica and anti-foaming agents Such mesh network acts not as a static network but exhibits a dynamic and fluidic behavior; for example, such agglomerates may slide along each other and continuously change the network configuration while still exhibiting general mesh network behavior. This fluidic mesh network results in added hysteresis of the matrix during deformation, which results in dampening properties of the matrix in the string.

Contrary to classic lacquers with pigment sizes ranging from 10 micrometers (fine granulate) to 250 micrometers (coarse granulate), the nano-particle agglomerates allow the dampening abilities of the binding agent to be adjusted in very fine steps. Since agglomerate structures of the primary nanoparticles separate relatively easily, the viscoelasticity of the infused lacquer or binding agent is preserved, which is a requirement for dampening agents used in musical strings. Through their embedding in the binding agent of the matrix, and due to their mobility, the nano-particle agglomerates act as additional, reversible mechanical dampeners. The acoustical coupling between the string core and its additional wound layers can thus be configured both very accurately and variedly through the conscious selection of nano-particle size, particle morphology, particle concentration, chemical properties of particles and the overall interaction of the aforementioned factors.

Optionally, these solid particles are not magnetic in contrast to the particles as disclosed in U.S. Pat. No. 7,893,331. For example, the particles are not ferromagnetic and not ferromagnetic. Optionally, in addition or alternatively, the particles are free from heat activated pigments, in contrast to US2009/0158912.

Examples of nano-particles for use in the way described, include silicate particles, for example silicon oxide, hydrated aluminum silicate or hydrated magnesium silicate, or oxides and hydroxides, for example aluminum oxide, titanium oxide and magnesium oxide, carbonates, sulfates or sulfides. Alternatively, the nano-particles comprise one or more of these compounds.

The individual size of the nano-particles must be between 10 nm and 500 nm, for example between 10 and 250 nm, end points of the intervals optionally included. Optionally, their morphology is amorphic. This employment of nano-particle agglomerates in the dampening and binding agent to achieve a defined configuration and adjustment of dampening abilities, and thus acoustical sound characteristics of musical strings, is hitherto unknown.

In further embodiments, the solid state particles are not carbon nano fibres nor carbon nano spheres, or they are made up of not only carbon nano fibres or not only carbon nano spheres. For example, the nano-particles are not comprised solely of carbon nano fibres or carbon nano spheres, rather also of at least silicates, oxides, sulfates or other carbonic particles as outlined above.

The following section demonstrates examples of polymer matrix compositions according to the invention and the resulting changes in the sound characteristics of the musical string.

Composition 1: A nano-scale particle powder consisting of silicon oxide with a median particle size of 50 nm is added to the polymer binding agent such that it constitutes, by mass, 1% of the mixture. The particles are mixed evenly into the binding agent.

Composition 2: A nano-scale particle powder consisting of silicon oxide with a median particle size of 250 nm is added to the polymer binding agent such that it constitutes, by mass, 3% of the mixture. The particles are mixed evenly into the binding agent.

Composition 3: A nano-scale particle powder consisting of titanium oxide with a median particle size of 100 nm is added to the polymer binding agent such that it constitutes by mass 6% of the mixture. The particles are mixed evenly into the binding agent.

Composition 4: A nano-scale particle powder consisting of silicon oxide with a median particle size of 250 nm is added to the polymer binding agent such that it constitutes by mass 6% of the mixture. The particles are mixed evenly into the binding agent.

The core consist of solid metal wire, metal multi-filaments, multi-stranded helical metal wire of various winding, polymer mono- or multi-filaments, as well as natural fibers and natural materials such as animal gut. In addition, the musical string has one or more further winding layers in the form of round or flat wire(s) wound around the core to provide at least one sheath around the core to reach a specified density of mass of the string. Typical winding materials include suitable metals and polymer materials, and including synthetic and natural fibers. The term sheath is used as a general term for a wire that is wound, typically spirally wound, around the core.

For the matrix, the following binding agents (list not being exhaustive) are regarded as useful: natural resins, preferable natural resins based on colophony and colophony derivates, resins of natural oils and oil derivates, synthetic resins, preferable polyamide and polyimide resins, phenolic resins, polyester resins and epoxy resins.

In practice, the sound spectrum is adjusted by measuring a sound profile on a string without the dampening polymer matrix and measuring a comparative sound profile of a corresponding string with a dampening polymer matrix included in the string. The sound profiles are then compared for evaluation of the difference of the acoustical properties pertaining to the addition of the polymer matrix. For the actual invention the sound spectra are measured on strings having a polymer matrix dampening agent without nano-particle infusion and compared to the sound profile of a corresponding string with a nano-particle modified dampening polymer matrix included in the string. The sound profiles are then compared for evaluation of the difference of the acoustical properties pertaining to the addition of the nano-particles.

SHORT DESCRIPTION OF THE FIGURES

In this respect, the invention will be described with reference to the figures

FIG. 1: Comparison of sound spectra. Cello A string without modification (Reference) against Cello A string with binding agent modification (Composition 3).

FIG. 2: Comparison of sound spectra. Cello A string without modification (Reference) against Cello A string with binding agent modification (Composition 4).

Figure 3:
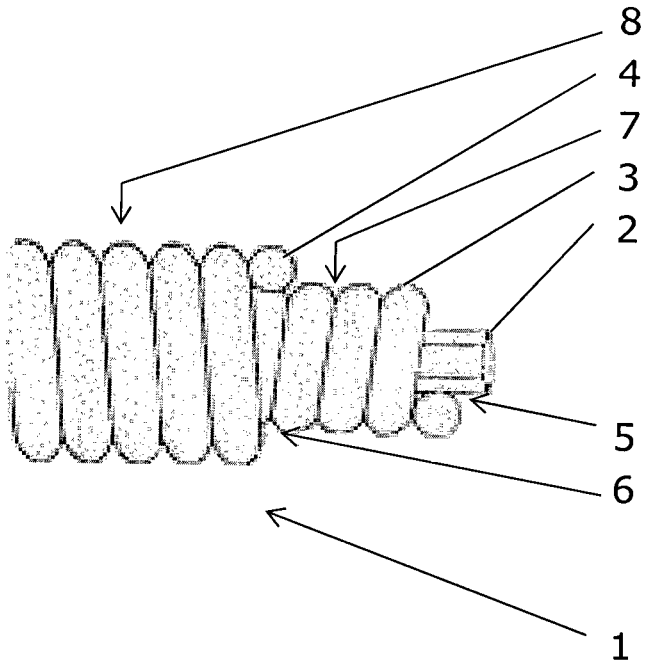

FIG. 3: An example of a string according to the invention.

DETAILED DESCRIPTION

Objective measurement of sound character is made possible through sound analysis which can be visualized as a sound spectrum showing the fundamental tone at its resonant frequency, including the overtones which give the sound its unique character.

FIG. 1 and FIG. 2 show the two sound spectra produced by Composition 3 and 4 respectively. FIG. 1 compares the spectrum of a Cello A string containing regular binding agent without modification (reference) with a Cello A string in which the binding agent has been infused with nano-particles as specified in Composition 3. This binding agent contained, by mass, 6% titanium oxide nano-particles with a median particle size of 100 nm. The result shows marked sound spectrum changes. Following binding agent modification, the peak vibration level (dB) of the 5th harmonic overtone (=major third) is reduced, the 6th harmonic overtone (=fifth) is increased, the 7th harmonic overtone (=flat seventh) is increased, and the 8th harmonic overtone (=octave) is reduced. The developed A string exhibits a new, altered sound profile.

Comparably, FIG. 2 reveals differences between the sound spectra of a reference Cello A string and a Cello A string with binding agent modification as specified in Composition 4. This binding agent contained, by mass, 6% silicon oxide nano-particles with a median particle size of 250 nm. As is obvious, the binding agent modification of Composition 4 achieves a radically altered sound spectrum when compared to the reference, but is also distinctly different from Composition 3 in FIG. 1. The peak vibration level of the 3rd harmonic overtone (=fifth) is reduced, the 4th harmonic overtone (=octave) is slightly elevated, whereas the peak vibration levels of the 5th, 6th, 7th and 8th harmonic overtones are all reduced. The modification to this Cello A String results in greater dampening of certain aspects of its sound.

As illustrated in FIG. 3, the string 1 comprises a core 2 and a first wound sheath 3 wound directly around the core and a second sheath 4 wound around the core 2 by being wound around the first sheath 3. The sound-dampening viscoelastic polymer matrix is provided around the core 2 in the interspace 5 between the core 2 and the first sheath 3. It is also provided in the interstices 7 between the windings of the first sheath 3. Furthermore, alternatively or in addition, the sound-dampening viscoelastic polymer matrix can be provided in the interspace 6 the first wound sheath and the second wound sheath 4 and correspondingly in the interstices between the windings of the second wound sheath. However, due to its viscoelastic properties, which implies stickiness and high friction, the polymer matrix is to be avoided on the surface 8 of the string 1. Instead, a low friction polymer matrix can be applied to the surface, for example as described in US2009/0158912.

Aspects:

In the following, optional embodiments are described as aspects.

Aspect 1. Musical string, particularly for bowed and plucked instruments, comprising at least a core and at least one sheath wound around that core, further comprising a dampening and/or binding agent applied to at least one of the following: The core, between the core and the first wound sheath, on the sheath material, between wound sheaths; wherein the dampening and/or binding agent in well defined form contains insoluble, sub-micrometer size, nano-scale solid state particles, wherein solid state particles are non-magnetic.

Aspect 2. Musical string according to aspect 1, wherein sub-micrometer size, nano-scale solid state particles are embedded in the binding agent matrix, forming a mesh network of independently mobile nano-particle agglomerates.

Aspect 3. Musical string according to aspect 1 or 2, wherein sub-micrometer size, nano-scale solid state particles are inorganic and/or inorganic-organic in nature.

Aspect 4. Musical string according to aspect 1 or 2, wherein sub-micrometer size, nano-scale particles are silicate containing, oxide containing, sulfate containing, sulfide containing and/or carbonate containing particles.

Aspect 5. Musical string according to aspect 1 or 2, wherein sub-micrometer size, nano-scale solid state particles consists primarily of silicates, oxides or hydroxides, or comprises at least one of these compounds.

Aspect 6. Musical string according to aspect 4, wherein sub-micrometer size, nano-scale solid state particles either consist or comprise at least of one of the following compounds: Silicon oxide, hydrated aluminum silicate, hydrated magnesium silicate, aluminum oxide, titanium oxide, magnesium oxide, carbonate and sulfate.

Aspect 7. Musical string according to aspect 1, 2, 3, 4, 5, or 6, wherein sub-micrometer size, nano-scale solid state particles have a median size of 10-500 nm.

Aspect 8. Method of configuration and adjustment of dampening properties, and thereby the acoustical properties of musical strings, particularly for bowed and plucked instruments, in which insoluble, non-magnetic, sub-micrometer size, nano-scale solid state particles are added to a dampening and binding agent, applied to at least one of the following: The core, between the core and the first wound sheath, onto the sheath material or between wound sheaths.

Aspect 9. Method according to aspect 8, wherein sub-micrometer size, nano-scale solid state particles are silicate-containing, oxide-containing, sulfate-containing, sulfide-containing and/or carbonate-containing particles.

Aspect 10. Use of a dampening and/or binding agent infused with insoluble, sub-micrometer size, nano-scale solid state particles for defined configuration and adjustment of dampening properties and thus acoustical properties of musical strings.

Aspect 11. Use of a dampening and binding agent infused with insoluble, sub-micrometer size, nano-scale solid state particles for defined configuration and adjustment of at least one of the following properties of musical strings: Mechanical stability, stiffness, flexibility and lifespan.

Aspect 12. Use according to aspect 10 or 11, wherein sub-micrometer size, nano-scale solid state particles are non-magnetic.

Aspect 13. Use according to aspect 10 or 11, wherein sub-micrometer size, nano-scale solid state particles are silicate-containing, oxide-containing, sulfate-containing, sulfide-containing and/or carbonate-containing particles.

The invention claimed is:

1. A musical string for bowed and plucked instruments comprising a core and at least one sheath wound around the core, further comprising a polymer matrix between the core and the at least one wound sheath or between wound sheaths or both; wherein the polymer matrix comprises a polymeric binding agent and insoluble, sub-micrometer size, nano-scale solid state particles embedded in the binding agent, characterized in that the polymer matrix is viscoelastic, wherein the particle concentration is between 30 g and 60 g of particles per kg of polymer matrix.

2. A musical string for bowed and plucked instruments comprising a core and at least one sheath wound around the core, further comprising a polymer matrix between the core and the at least one wound sheath or between wound sheaths or both; wherein the polymer matrix comprises a polymeric binding agent and insoluble, sub-micrometer size, nano-scale solid state particles embedded in the binding agent, characterized in that the polymer matrix is viscoelastic, wherein the solid state particles are non-magnetic or free from heat activated pigments or both.

3. The musical string according to claim 2, wherein the sub-micrometer size, nano-scale solid state particles form a mesh network of independently mobile nano-particle agglomerates.

4. The musical string according to claim 2, wherein the viscosity of the binding agent is in the range of 60.000-400.000 mPa*s at 25° C.

5. The musical string according to claim 2, wherein a concentration of said particles is between 10 g and 100 g of particles per kg of polymer matrix.

6. The musical string according to claim 2, wherein the sub-micrometer size, nano-scale solid state particles are inorganic and/or inorganic-organic.

7. The musical string according to claim 2, wherein the sub-micrometer size, nano-scale particles contain at least one of the following: silicate, oxide, sulfate, carbonate.

8. The musical string according to claim 2, wherein the sub-micrometer size, nano-scale solid state particles comprise at least one of silicates, oxides or hydroxides.

9. The musical string according to claim 2, wherein the sub-micrometer size, nano-scale solid state particles comprise at least of one of the following compounds: silicon oxide, hydrated aluminum silicate, hydrated magnesium silicate, aluminum oxide, titanium oxide, magnesium oxide, carbonate and sulfate.

10. A musical string for bowed and plucked instruments comprising a core and at least one sheath wound around the core, further comprising a polymer matrix between the core and the at least one wound sheath or between wound sheaths or both; wherein the polymer matrix comprises a polymeric binding agent and insoluble, sub-micrometer size, nano-scale solid state particles embedded in the binding agent, characterized in that the polymer matrix is viscoelastic, wherein the sub-micrometer size, nano-scale solid state particles have a median size of 10-500 nm.

11. The musical string according to claim 10, wherein median size is 10-50 nm.

12. A method for configuration and adjustment of acoustical properties of a musical string for bowed and plucked instruments; the string comprising a core and at least one sheath wound around that core; the method comprising providing a polymer matrix between the core and the at least one wound sheath or between wound sheaths or both; wherein the polymer matrix comprises a polymeric binding agent and insoluble, sub-micrometer size, nano-scale solid state particles embedded in the binding agent, characterized in that the polymer matrix is viscoelastic, wherein the solid state particles are non-magnetic or free from heat activated pigments or both.

13. The method according to claim 12, wherein the viscosity of the binding agent is in the range of 60.000-400.000 mPa*s at 25° C.

14. The method according to claim 12, wherein the sub-micrometer size, nano-scale particles contain at least one of the following: silicate, oxide, sulfate, carbonate.

15. The method according to claim 12, wherein the sub-micrometer size, nano-scale solid state particles comprise at least one of silicates, oxides or hydroxides.

16. The method according to claim 12, wherein the sub-micrometer size, nano-scale solid state particles comprise at least of one of the following compounds: silicon oxide, hydrated aluminum silicate, hydrated magnesium silicate, aluminum oxide, titanium oxide, magnesium oxide, carbonate and sulfate.

17. The method according to claim 12, wherein the method comprises measuring a sound profile on a string without polymer matrix and measuring a comparative sound profile of a corresponding string with a polymer matrix included in the string and comparing the sound profiles for evaluation of the difference of the acoustical properties pertaining to the addition of the polymer matrix.

18. The method according to claim 12, wherein the sub-micrometer size, nano-scale solid state particles are inorganic and/or inorganic-organic.

19. A method for configuration and adjustment of acoustical properties of a musical string for bowed and plucked instruments; the string comprising a core and at least one sheath wound around that core; the method comprising providing a polymer matrix between the core and the at least one wound sheath or between wound sheaths or both; wherein the polymer matrix comprises a polymeric binding agent and insoluble, sub-micrometer size, nano-scale solid state particles embedded in the binding agent, characterized in that the polymer matrix is viscoelastic, wherein the method comprises inducing in the polymer matrix the formation of a mesh network of independently mobile agglomerates by the sub-micrometer size, nano-scale solid state particles.

20. The method according to claim 19, wherein the inducing of the agglomeration comprises adjusting the concentration the sub-micrometer size, nano-scale solid state particles above a pre-determined limit, wherein the pre-determined limit is equal to or above the lower concentration limit for formation of a mesh network of independently mobile agglomerates.

21. The method according to claim 20, wherein the pre-determined limit is at least 10 g particles per kg of polymer matrix.

22. A method for configuration and adjustment of acoustical properties of a musical string for bowed and plucked instruments; the string comprising a core and at least one sheath wound around that core; the method comprising providing a polymer matrix between the core and the at least one wound sheath or between wound sheaths or both; wherein the polymer matrix comprises a polymeric binding agent and insoluble, sub-micrometer size, nano-scale solid state particles embedded in the binding agent, characterized in that the polymer matrix is viscoelastic, wherein the particle concentration is in the range of 10-100 g particles per kg polymer.

23. A method for configuration and adjustment of acoustical properties of a musical string for bowed and plucked instruments; the string comprising a core and at least one sheath wound around that core; the method comprising providing a polymer matrix between the core and the at least one wound sheath or between wound sheaths or both; wherein the polymer matrix comprises a polymeric binding agent and insoluble, sub-micrometer size, nano-scale solid state particles embedded in the binding agent, characterized in that the polymer matrix is viscoelastic, wherein the particle concentration is in the range of 30-60 g particles per kg polymer.

24. A method for configuration and adjustment of acoustical properties of a musical string for bowed and plucked instruments; the string comprising a core and at least one sheath wound around that core; the method comprising providing a polymer matrix between the core and the at least one wound sheath or between wound sheaths or both; wherein the polymer matrix comprises a polymeric binding agent and insoluble, sub-micrometer size, nano-scale solid state particles embedded in the binding agent, characterized in that the polymer matrix is viscoelastic, wherein the sub-micrometer size, nano-scale solid state particles have a median size of 10-500 nm.

25. The method according to claim 24, wherein median size is 10-250 nm.

* * * * *